US010488049B2

(12) United States Patent
Lunel et al.

(10) Patent No.: US 10,488,049 B2
(45) Date of Patent: Nov. 26, 2019

(54) TURBOMACHINE COMBUSTION CHAMBER

(71) Applicant: Safran Aircraft Engines, Paris (FR)

(72) Inventors: Romain Nicolas Lunel, Moissy-Cramayel (FR); Thomas Olivier Marie Noel, Moissy-Cramayel (FR); Matthieu François Rullaud, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 321 days.

(21) Appl. No.: 15/516,070

(22) PCT Filed: Sep. 29, 2015

(86) PCT No.: PCT/FR2015/052588
§ 371 (c)(1),
(2) Date: Mar. 31, 2017

(87) PCT Pub. No.: WO2016/051067
PCT Pub. Date: Apr. 7, 2016

(65) Prior Publication Data

US 2017/0299192 A1 Oct. 19, 2017

(30) Foreign Application Priority Data

Oct. 1, 2014 (FR) ..... 14 59362

(51) Int. Cl.
*F23R 3/28* (2006.01)
*F23R 3/60* (2006.01)
(Continued)

(52) U.S. Cl.
CPC ..... *F23R 3/50* (2013.01); *F23R 3/283* (2013.01); *F23R 3/60* (2013.01); *F23R 3/10* (2013.01);
(Continued)

(58) Field of Classification Search
CPC ..... F23R 3/10; F23R 3/16; F23R 3/28; F23R 3/283; F23R 3/50; F23R 3/60;
(Continued)

(56) References Cited

U.S. PATENT DOCUMENTS 4,870,818 A * 10/1989 Suliga ..... F23R 3/283 60/740
5,172,545 A * 12/1992 Forestier ..... F23R 3/283 29/8

(Continued)

FOREIGN PATENT DOCUMENTS

EP 1 785 671 A1 5/2007
EP 2 518 408 A2 10/2012
GB 2 237 502 A 5/1991

*Primary Examiner* — Todd E Manahan
*Assistant Examiner* — Eric W Linderman
(74) *Attorney, Agent, or Firm* — Blank Rome LLP

(57) ABSTRACT

The invention relates to a combustion chamber for a turbomachine, such as an aircraft turbojet engine or turboprop engine, comprising an internal annular shroud and an external annular shroud which at their upstream ends are connected by an annular chamber end wall (48), said chamber comprising deflectors (50) mounted upstream of the annular chamber end wall (48). Injectors (19) are mounted in sleeves (44) at least one of which comprises a radially annular flange (66) which is designed to slide radially between the chamber end wall (48) and the deflector (50) and which is blocked axially between the chamber end wall (48) and the deflector (50).

8 Claims, 2 Drawing Sheets

(51) Int. Cl.
*F23R 3/10* (2006.01)
*F23R 3/00* (2006.01)
*F23R 3/50* (2006.01)
*F23R 3/16* (2006.01)

(52) U.S. Cl.
CPC . *F23R 3/16* (2013.01); *F23R 3/28* (2013.01); *F23R 2900/00017* (2013.01); *F23R 2900/03041* (2013.01); *F23R 2900/03042* (2013.01)

(58) Field of Classification Search
CPC .. F23R 2900/00017; F23R 2900/03041; F23R 2900/03042
See application file for complete search history.

(56) References Cited

U.S. PATENT DOCUMENTS 5,222,358 A * 6/1993 Chaput ..... F23R 3/283 60/740
5,533,330 A * 7/1996 Mullooly ..... F23R 3/283 60/39.821
5,577,379 A * 11/1996 Johnson ..... F23R 3/10 60/740
5,916,142 A * 6/1999 Snyder ..... F23C 7/004 60/740
5,956,955 A * 9/1999 Schmid ..... F23R 3/283 60/748
7,140,189 B2 * 11/2006 Markarian ..... F23R 3/10 60/796
7,673,460 B2 * 3/2010 Hernandez ..... F23R 3/10 60/752
7,690,207 B2 * 4/2010 Markarian ..... F23R 3/002 60/752
7,926,280 B2 * 4/2011 Morenko ..... F23R 3/002 60/740
8,701,417 B2 * 4/2014 Nicholls ..... F23R 3/10 60/756
8,763,406 B2 * 7/2014 Pieussergues ..... F23R 3/10 60/756
9,021,812 B2 * 5/2015 Pardington ..... F23R 3/14 60/748
9,243,561 B2 * 1/2016 Carlisle ..... F23R 3/002
9,556,794 B2 * 1/2017 Falempin ..... F02C 3/14
9,759,427 B2 * 9/2017 Kidder ..... F02C 3/04
10,041,415 B2 * 8/2018 Clemen ..... F02C 7/28
10,088,166 B2 * 10/2018 Drake ..... F23R 3/28
10,101,031 B2 * 10/2018 Williams ..... F23R 3/12
10,253,976 B2 * 4/2019 Gunderson ..... F23D 11/383
2006/0207258 A1 * 9/2006 Tanner ..... F23C 5/02 60/748
2007/0199329 A1 * 8/2007 Hernandez ..... F23R 3/283 60/746
2011/0113789 A1 5/2011 Duval et al.
2017/0248320 A1 * 8/2017 Hannwacker ..... F23R 3/14

* cited by examiner

TURBOMACHINE COMBUSTION CHAMBER

The present invention relates to a combustion chamber in a turbomachine, as well as a turbomachine equipped with a combustion chamber.

In a known technique, an annular combustion chamber comprises two coaxial internal and external annular shrouds connected together at their upstream ends by a so-called annular chamber end wall which comprises openings for the passage of injector heads. Each injector is engaged in a centring sleeve which can move in the radial direction in support means integral with the chamber end wall.

In the present technique, the downstream end of the sleeve is provided with an annular collar which radially extends outwards and so mounted as to slide in an annular groove provided in the support means integral with the annular chamber end wall.

The annular groove enables a radial and circumferential displacement of the sleeve accommodating the injector so as to make up for the manufacturing tolerances which may lead to misalignment of the injector with the fuel injection axis between the internal and external shrouds of the combustion chamber. It also enables to compensate for the differential expansions in operation between the injector and the chamber.

The annular groove for the radial displacement of the sleeve is defined by axial retention means in the upstream direction and in the downstream direction of the radial annular collar. In practice, the axial retention means in the downstream direction consist of a downstream radial wall of an annular sheath fixed on the annular chamber end wall, with the radial wall being connected to a cylindrical rim which extends in the upstream direction and whereon a washer, inserted on the cylindrical rim and defining the above-mentioned groove with the radial annular wall, is welded or brazed.

Such washer is thus permanently fixed on the sheath. When the injector and the sleeve have to be dismounted, the brazer of this washer has to be unsoldered or eliminated, which is a delicate operation since the sheath which is fixed on the annular chamber end wall must not be damaged. Besides, weld beads breaking have been noted, which is not admissible, and does not ensure a perfect mechanical integrity of the fuel injection systems.

The invention more particularly aims at providing a simple, efficient and cost-effective solution to the problems of the prior art disclosed above.

For this purpose, it provides for a combustion chamber for a turbomachine, such as an aircraft turbojet engine or a turboprop engine, comprising an internal annular shroud and an external annular shroud which, at their upstream ends are connected by an annular chamber end wall, with said chamber comprising deflectors mounted downstream of the annular chamber end wall, with injectors being mounted in sleeves, at least one of which comprises a radially annular collar which is arranged to slide radially between the chamber end wall and the deflector and which is axially blocked between the chamber end wall and the deflector.

The invention makes it possible to eliminate the sheath fixing each injector and thus to reduce the weight of the combustion chamber. According to the invention, the axial spacing between the deflector and the annular chamber end wall accommodates the sleeve collar which can freely slide therein, which also makes it possible to reduce the axial overall dimensions of the combustion chamber by using said space, which was not used in the prior art.

According to another characteristic of the invention, the combustion chamber comprises first rotation blocking means of the sleeve on the deflector and second rotation blocking means of the deflector on the chamber end wall. The sleeve anti-rotation relative to the injector axis is thus provided by the deflector itself rotationally blocked on the annular chamber end wall.

In one embodiment of the invention, the collar carries at least one member radially protruding outwards. Such member can be axially positioned between the annular chamber end wall and the deflector so as to provide the axial blocking of the sleeve on the chamber end wall and the deflector.

The first rotation blocking means preferably comprise a radial groove provided on the upstream face of the deflector and wherein said member is engaged.

According to another characteristic of the invention, the deflector comprises a central annular wall having the same axis as the injector and axially extending in the upstream direction and through an opening for the passage of an injector of the annular chamber end wall, with said annular wall of the deflector comprising a notch for mounting the collar so that it axially slides up to said groove of the deflector.

The second rotation blocking means advantageously comprise a pin provided on the inner peripheral edge of said opening of the chamber end wall and radially protruding inwards into said notch.

According to still another characteristic of the invention, a ring is screwed onto the outer periphery of the central annular wall and applied onto the perimeter of the upstream face of the chamber end wall opening.

Such mounting provides the axial blocking of the deflector on the annular chamber end wall.

The ring may be welded onto the deflector annular wall to prevent any unscrewing of the ring in operation.

The sleeve may comprise two members each forming a lug radially extending outwards, preferably diametrally opposed.

The annular chamber end wall and the deflector advantageously comprise ventilation air holes.

The annular collar preferably comprises an annular row of ports, the axes of which lead to a radial annular rim of the sleeve which is provided downstream.

The ports in the collar make it possible to efficiently cool the radial annular rim thanks to the orientation of the axes of the ports perpendicularly to the radial rim and the reduced distance between the collar and the radial annular rim.

The invention also relates to a turbomachine, such as a turbojet or a turboprop, comprising a combustion chamber as described above.

The invention will be better understood, and other details, characteristics and advantages of the invention will appear upon reading the following description given by way of a non restrictive example while referring to the appended drawings wherein.

Figure 1:
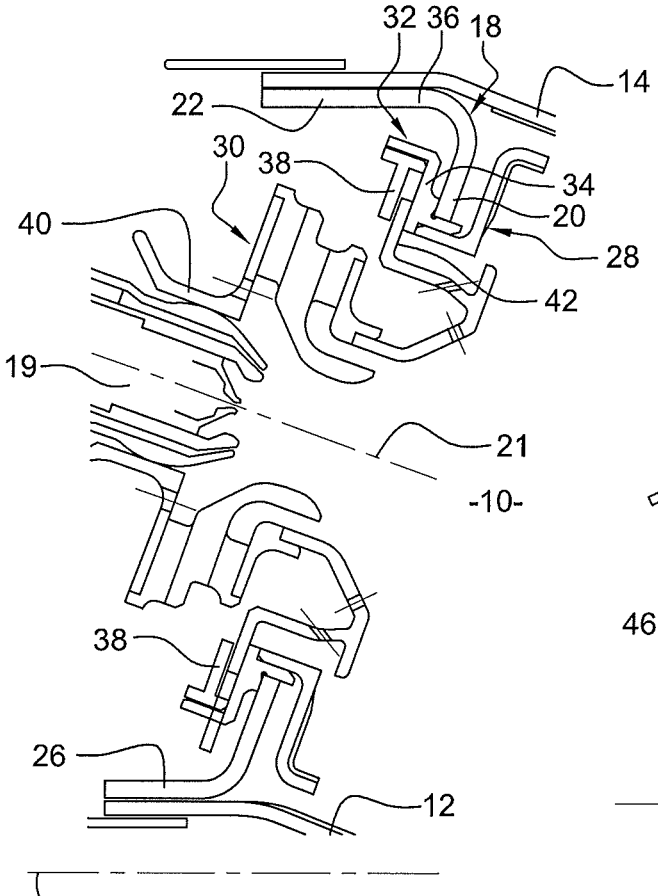
Fig. 1 (PRIOR ART)
FIG. 1 is a schematic view, in axial cross-section, of the upstream portion of a combustion chamber according to the prior art.
Figure 2:
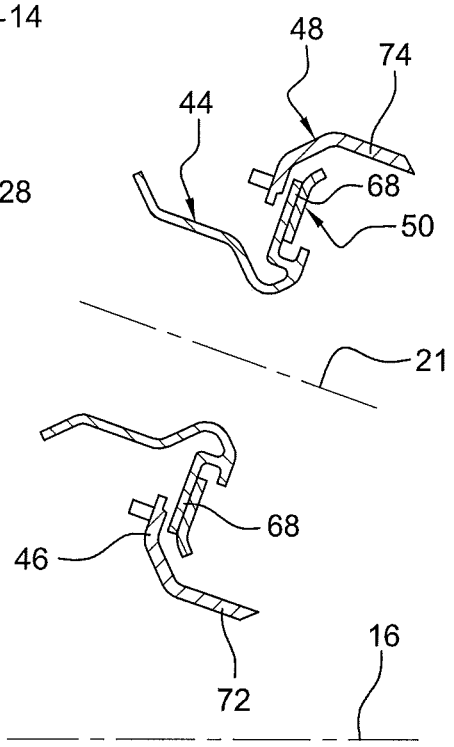
FIG. 2 is a schematic view, in axial cross-section, of the upstream portion of a combustion chamber according to the invention.

Reference is first made to FIG. 1 which shows the upstream portion of a combustion chamber 10 in a turbomachine according to the known technique comprising two internal and external shrouds 12,14 which extend about the axis 16 of the combustion chamber 10 and are fixed at the upstream ends thereof to an annular chamber end wall 18 extending between the internal and external walls 12,14 of revolution and traversed by fuel injectors 19, having an axis 21. The annular chamber end wall 18 comprises a radial annular wall 20, the external periphery of which is connected to an external cylindrical rim 22 which extends in the upstream direction and is fixed on the upstream end of the external shroud 14. The radial annular wall 20 of the chamber end wall 18 has an inner periphery connected to an internal cylindrical rim 26 which extends in the upstream direction and is fixed on the upstream end of the internal shroud 12.

The radial annular wall of the chamber end wall 18 comprises a plurality of openings each aligned with one opening of a deflector 28 arranged downstream of the radial annular wall 20 of the annular chamber end wall 18. The deflectors 28 are intended to protect the chamber end wall 18 from the flame formed downstream, between the internal and external shrouds 12, 14.

Each injector 19 is axially engaged into centring means 30, which can freely be moved in the radial direction in support means 32 integral with the annular chamber end wall 18.

The support means 32 of each injector 19 comprise a sheath consisting of a radial annular wall 34 fixed about the opening for the passage of the injector 19 and on the upstream face of the radial annular wall 20 of the chamber end wall 18. The radially external end of the radial annular wall 34 is connected to a cylindrical rim 36 which extends in the upstream direction.

In the prior technique (FIG. 1), for each injection system, a washer 38 is fixed by welding or brazing the radially external periphery thereof onto the upstream end of the cylindrical rim 36 of the sheath.

In the known technique, the centring means of each injector 19 comprise a cylindrical part 40 axially gone through by the head of the injector 19 and connected, downstream, to an annular collar 42 which radially extends outwards and so mounted as to radially slide in the groove delimited upstream by the washer 38 and downstream by the radial annular wall 34. The bottom of the groove is externally defined by the cylindrical rim 36.

As explained above, the weld beads holding the washers may be weakened and are thus liable to break in operation, which affects the injection of fuel between the internal and external walls 12, 14 of revolution.

According to the invention disclosed with reference to FIGS. 3 to 7, each injector is engaged in a sleeve 44 which is so mounted as to radially slide between the radial annular wall 46 of the chamber end wall 48 and the deflector 50, and which is also blocked axially in the upstream direction by the radial annular wall 46 of the chamber end wall 48 and axially in the downstream direction by the deflector 50.

Figure 3:
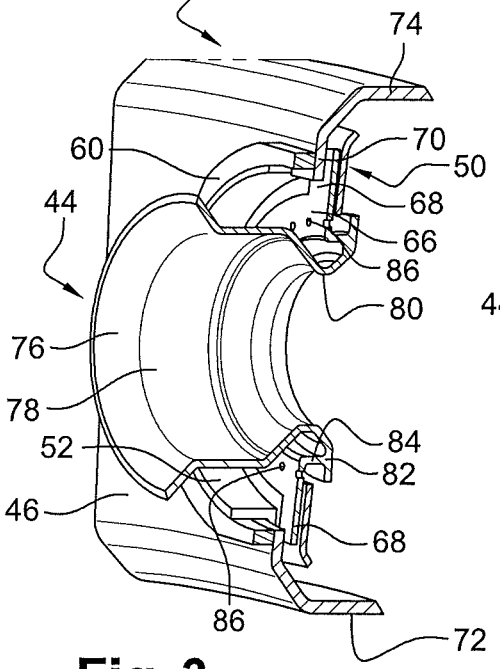
FIG. 3 is a schematic view in perspective from upstream, in cross-section, in a plane containing the axis of an injector and the axis of the combustion chamber.
Figure 4:
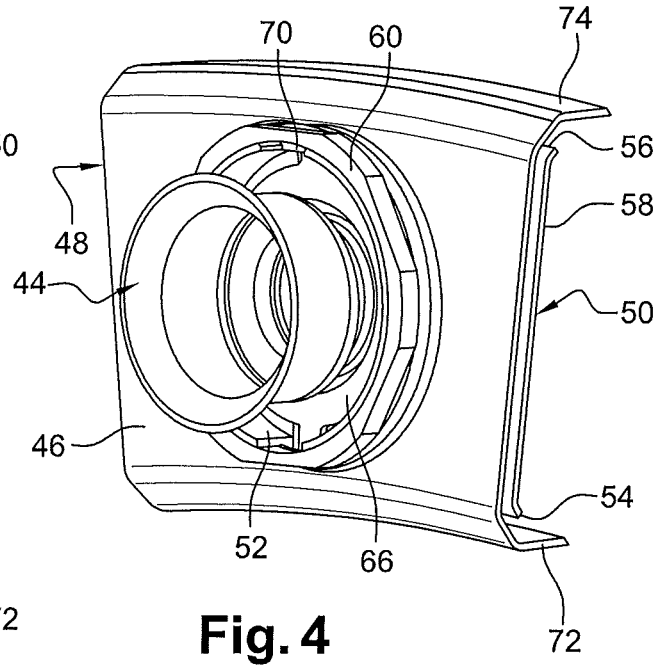
FIG. 4 is a schematic view, in perspective, from upstream, of an injection device in a combustion chamber according to the invention.

Each deflector 50 has the general shape of an angular sector and comprises a central cylindrical annular wall 52 which extends in the upstream direction, an internal peripheral edge 54 and an external peripheral edge 56 connected by radial side edges 58 (FIG. 4). The deflectors 50 are so positioned as to be adjacent on the circumference so as to form a radial annular arrangement thermal-insulating the annular chamber end wall 48. The external surface of the central annular wall 52 of each deflector 50 comprises a thread intended to receive a ring 60 which will be screwed thereon as shown in FIGS. 3 and 4.

The internal and external peripheral walls 54, 56 respectively have rims which extend in the downstream direction, parallel to the internal and external shrouds 12, 14 and spaced therefrom by a non null distance.

Figure 5:
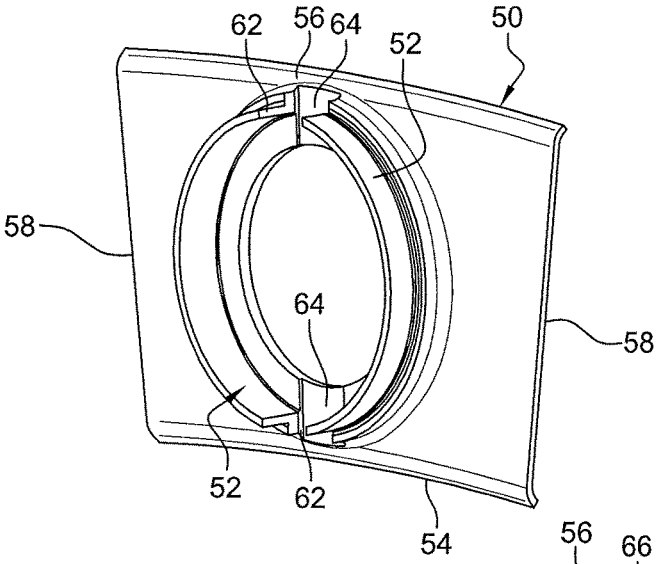
FIG. 5 is a schematic front view in perspective of a deflector alone.

The central annular wall 52 of each deflector 50 comprises two radial notches 62 diametrally opposed to one another and opening at the upstream end of the central annular wall 52. Each notch 62 opens downstream into a radial groove 64 formed on the upstream face of the deflector 50 sector. As shown in FIG. 5, each groove 64 has radially internal and external ends which are holes.

Each sleeve 44 comprises a tapered upstream wall 76 which is flared in the upstream direction, connected, at its downstream end, to a cylindrical wall 78, which is connected, at its downstream end, to a radially and annularly convex wall 80 curved inwards, the downstream end of which is extended by a radial annular rim 82 positioned downstream of a radial annular collar 66 which carries two rectangular members 68 or lugs extended in the radial direction, from its peripheral edge. The annular collar 66 is thus positioned substantially downstream of the sleeve and annularly extends about the curved wall 80. The annular collar 66 and the radial annular rim 82 are internally connected to the same cylindrical wall 84. The collar 66 advantageously comprises holes 86 or ports (FIG. 3). Such holes 86 are preferably so arranged as to form an annular row. The axes of the holes are parallel to the axis of the injector and are directed towards the radial annular rim 82. Air, which flows in the downstream direction through the holes 86 thus perpendicularly hits the annular rim 82, which cools it down in a good manner. Besides, the positioning of the annular collar 66 between the chamber end wall 48 and a deflector 50 makes it possible to reduce the axial distance (along the injector axis) between each hole 86 and the annular rim 82 relative to the prior art, thus limiting dispersions of the air flow and enhancing the cooling of the radial rim 82 exposed to the combustion flame.

Figure 6:
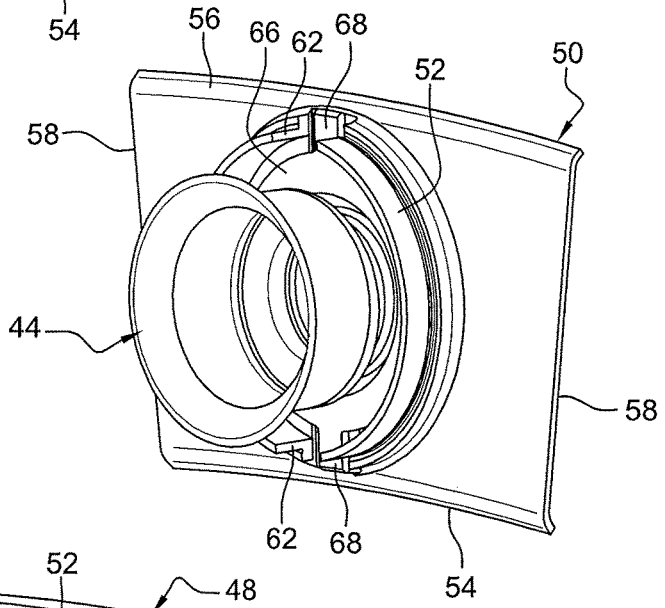
FIG. 6 is a schematic view, in perspective, of an injector centring sleeve and the deflector associated therewith.

As shown in FIG. 6, the sleeve 44 is engaged from upstream so that the lugs 68 can slide into the notches 62 so as to be each accommodated in a groove 64 of the deflector 50.

Each groove 64 thus forms first rotation blocking means of the sleeve 44 on the deflector 50.

Figure 7:
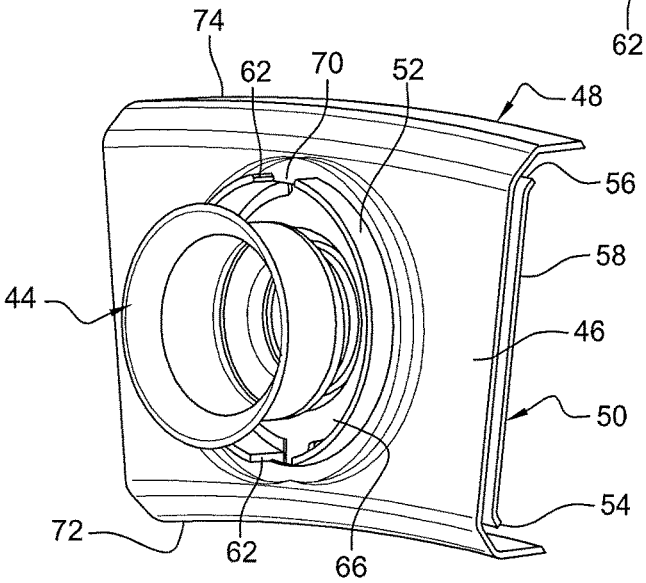
FIG. 7 is a schematic view, in perspective, similar to FIG. 4 without the clamping ring.

The inner peripheral edge of the opening of the radial annular wall 46 of the chamber end wall 48 which is aligned with the opening of the deflector 50 comprises a pin 70 radially protruding inwards. As can be seen in FIG. 7, the pin 70 is positioned in the notch 62 and forms second rotation blocking means intended to stop the rotation of the deflector 50 on the radial annular wall 46 of the chamber end wall 48.

The sleeve 44 is thus prevented to rotate about the axis 21 of the injector 19 by the deflector 50 which is prevented to rotate on the chamber end wall 48, too.

Mounting is executed by inserting the assembly consisting of the deflector 50 and the sleeve 44 through the chamber end wall 48 opening from downstream. The ring 60 is then screwed from upstream on the outer perimeter of the central annular wall 52 of the deflector 50 so as to be applied onto the upstream face of the radial annular wall 46 of the chamber end wall 48. One or more welding beads are provided at the contact zone between the ring 60 and the central annular wall 52 of the deflector 50 so as to prevent any loosening of the ring 60 in operation.

According to the invention, the sleeve 44 is guided to slide in the radial direction by means of the radial lugs 68 which slide in the grooves 64 of the deflector 50. The lugs 68 of the sleeve 44 provide the axial blocking of the sleeve 44 between the radial annular wall 46 of the chamber end wall 48 and the deflector 50.

The invention makes it possible to eliminate the sheath of the prior art and makes it possible to reduce the axial overall dimensions of the upstream part of the combustion chamber.

In the embodiment of the invention shown in FIGS. 2 to 4 and 7, the internal and external peripheral rims 72, 74 of the chamber end wall 48 are oriented in the downstream direction and not in the upstream direction. It should however be understood that such internal and external peripheral rims 72, 74 can also be oriented in the upstream direction without the definition of the invention being affected.

Although not shown in the figures, the radial annular wall 46 of the annular chamber end wall 48 and the deflector 50 may comprise ventilation air holes.

The invention claimed is:

1. A combustion chamber for a turbomachine in an aircraft turbojet engine or a turboprop engine, with said chamber comprising at least one deflector mounted downstream of the annular chamber end wall, with injectors each being mounted in a corresponding sleeve, at least one of which comprises a radially annular collar which is arranged to slide radially between the chamber end wall and the deflector and which is axially blocked between the chamber end wall and the deflector, with the chamber comprising a first rotation blocking means for stopping the rotation of the sleeve on the deflector and second rotation blocking means for stopping the rotation of the deflector on the chamber end wall, with the first rotation blocking means comprising a radial groove provided on the upstream face of the deflector engaged by a member carried by the collar and radially protruding outwards therefrom; and wherein the deflector comprises a central annular wall having the same central axis as the injector and axially extending in the upstream direction and through an opening for passage of an injector in the annular chamber end wall, with said annular wall of the deflector comprising a notch for mounting the collar so that the member axially slides up to said groove of the deflector.

2. A combustion chamber according to claim 1, wherein the member is axially positioned between the chamber end wall and the deflector for the axial blocking of the sleeve between the chamber end wall and the deflector.

3. A combustion chamber according to claim 1, wherein the second rotation blocking means comprise a pin provided on the inner peripheral edge of said opening of the chamber end wall and radially protruding inwards into said notch.

4. A combustion chamber according to claim 1, wherein a ring is screwed onto the outer periphery of the central annular wall and applied onto the perimeter of the upstream face of the chamber end opening.

5. A combustion chamber according to claim 2, wherein the sleeve comprises two members each forming a lug radially extending outwards, preferably diametrally opposed.

6. A combustion chamber according to claim 1, wherein the annular chamber end wall and the deflector comprise ventilation air holes.

7. A combustion chamber according to claim 1, wherein the annular collar comprises an annular row of ports, the axes of which lead to a radial annular rim of the sleeve which is provided downstream.

8. A turbomachine such as a turbojet or a turboprop, comprising a combustion chamber according to claim 1.

* * * * *